United States Patent [19]

Hens

[11] Patent Number: 4,970,524

[45] Date of Patent: Nov. 13, 1990

[54] BROADBAND TRANSMISSION LINE COUPLED ANTENNA

[75] Inventor: Russell J. Hens, Bethesda, Md.

[73] Assignee: The United States of America as represented by the Secretary of the Army, Washington, D.C.

[21] Appl. No.: 310,048

[22] Filed: Feb. 13, 1989

[51] Int. Cl.[5] ..... H01Q 9/36

[52] U.S. Cl. ..... 343/752; 343/707; 343/826; 343/829

[58] Field of Search ..... 343/707, 749, 790, 751, 343/752, 824–826, 829–831, 897, 899, 907, 908

[56] References Cited

U.S. PATENT DOCUMENTS

| | | | |
|---|---|---|---|
| 1,689,400 | 10/1928 | Manley . | |
| 1,712,023 | 5/1929 | Bernard . | |
| 2,250,531 | 7/1941 | Hansell | 343/826 |
| 2,282,402 | 5/1942 | Hefele | 343/907 |
| 3,521,169 | 7/1970 | Turner et al. | 343/752 |
| 3,550,145 | 12/1970 | Tai . | |
| 3,808,599 | 4/1974 | Brunner . | |
| 3,931,625 | 1/1976 | Chiron et al. . | |
| 4,125,840 | 11/1978 | Cassel | 343/826 |
| 4,302,760 | 11/1981 | Laufer . | |
| 4,630,060 | 12/1986 | Newcomb | 343/722 |

FOREIGN PATENT DOCUMENTS

| | | | |
|---|---|---|---|
| 881413 | 4/1945 | France | 343/826 |
| 1302372 | 1/1973 | United Kingdom | 343/908 |

OTHER PUBLICATIONS

Reference Data for Engineers: Radio, Electronics, Computer and Communications (E. Jordan, ed., 7th ed., 3rd printing, 1986), Howard W. Sams & Co., 32–27 to 32–30.

*Primary Examiner*—Michael C. Wimer

*Attorney, Agent, or Firm*—Saul Elbaum; Guy M. Miller

[57] ABSTRACT

A broadband omnidirectional antenna has a monopole element driven by an rf source at one end and a load at its other end consisting of insulated parallel conductors tuned to different resonant frequencies. The parallel conductors are equidistantly spaced so that transmission line coupling occurs between adjacent conductors. The parallel conductors progressively decrease in length the further away each conductor is supported from the driven element. The antenna elements can be fabricated from attached insulated wires or ribbon cable and thus the antenna can have low weight, little bulk and great flexibility.

5 Claims, 4 Drawing Sheets

BROADBAND TRANSMISSION LINE COUPLED ANTENNA

RIGHTS OF THE GOVERNMENT

The invention described herein may be manufactured, used and licensed by or for the United States Government for Governmental purposes without payment to me of any royalty thereon.

BACKGROUND OF THE INVENTION

1. Field of the Invention

The present invention relates to a broad band high frequency (HF) or very high frequency (VHF) antenna of omnidirectional directivity and, more particularly, is directed towards a novel miniature wideband monopole antenna that has a load consisting of parallel conductors tuned to different resonant frequencies in which transmission line coupling occurs between adjacent conductors.

2. Description of the Prior Art

The purpose of an antenna is to convert the radio frequency (rf) circuit power provided at its input into output radiated power for transmission purposes and to convert radiated power into circuit power for reception purposes. Since the early days of radio, there has been constant endeavoring to improve the antenna, especially its characteristics pertaining to efficiency and bandwidth. The formula for the division of the rf power that is provided to an antenna is:

Input Power = Reflected Power + Dissipated Power + Radiated Power

Thus, for a fixed input power, decreasing the reflected power and decreasing the dissipated power will increase the radiated power (i.e., improve the antenna efficiency). Often wideband system requirements are limited by the antenna reflected power characteristics. Reflected power is caused by the impedance mismatch between the antenna input impedance characteristics and the characteristic impedance of the output stage or transmission line connecting the antenna to the transmitter. The difficulty of achieving a satisfactory impedance match over a broad band frequency range is caused by the antenna characteristics being frequency dependent and varying drastically with frequency. The frequency independent antenna is the only antenna class that minimizes broadband antenna characteristics changing drastically with frequency. However, frequency independent antenna theory and practice require physically large structures that approximate quarter wavelength (of lowest frequency) in two or more dimensions.

Certain applications require that a frequency independent VHF antenna be configured in one dimension, small in size, of light weight construction, storable for transportation and automatically deployable. One such application is as a deployable antenna from small fixed wing aircraft. Present broadband frequency independent antennas are inadequate for this application. Consequently, there is a need for a broadband HF-VHF antenna with all these characteristics.

Examples of prior art wideband antennas commonly use numerous monopole elements driven in parallel. These elements can also be driven with a 180 degree phase shift between elements as disclosed in U.S. Pat. No. 3,808,599 issued to Brunner. The monopole elements are usually tuned to separate frequencies within the operating band of the antenna array. This can be achieved by adjusting the length of the element or by adjusting a ferromagnetic core as disclosed in U.S. Pat. No. 3,931,625 issued to Chiron et al. However, none of these prior art antennas offer simultaneously the desired characteristics of a frequency independent, flexible, light weight, low mass, low air resistance, broadband antenna.

SUMMARY OF THE INVENTION

It is therefore a primary objective of the invention to provide an antenna that has broadband frequency independent characteristics.

It is a further object of the invention to provide an antenna that is broadband, frequency independent, omnidirectional, flexible and small in size.

The foregoing and other objects are attained in accordance with the invention through the use of a flexible monopole antenna with a "top" load consisting of a plurality of parallel connected flexible conductors each tuned to different resonant frequencies in which transmission line coupling occurs between conductors. The present antenna is unique to prior art antennas in that the common thread in the prior art antennas is that a monopole array is driven to achieve the broadband characteristics. This technique contrasts the present invention in which a single monopole element is driven at an input end while the other or "top" end has a load consisting of a plurality of frequency tuned conductors. These frequency tuned conductors are supported in a substantially planer and parallel relation to each other and equidistantly spaced so that transmission line coupling occurs between conductors. Consequently, the present antenna displays some of the control of antenna characteristics (specifically antenna input impedance) over a broad continuous range of frequencies while requiring only the wire length to be related to radiated wavelength (a single dimension). Thus the antenna has much less weight, mass, volume, air resistance and storage volume than that of a comparable frequency independent antenna of any known design.

One application of this invention is as a trailing wire antenna operating against the metallic airframe of an airplane. For this application an end weight is attached to the antenna which is folded and retained by a trap door. When the trap door is opened or jettisoned, the antenna automatically deploys and becomes ready for operation as an antenna. The end weight forces the antenna into an approximate vertical configuration to achieve the desired vertical polarization of the antenna characteristics.

BRIEF DESCRIPTION OF THE DRAWINGS

The foregoing and other objects, aspects, uses and advantages of the present invention will be more fully appreciated as the same becomes better understood when considered in connection with the following detailed description of the present invention and in conjunction with the accompanying drawings, in which.

DESCRIPTION OF THE PREFERRED EMBODIMENTS

Figure 1:
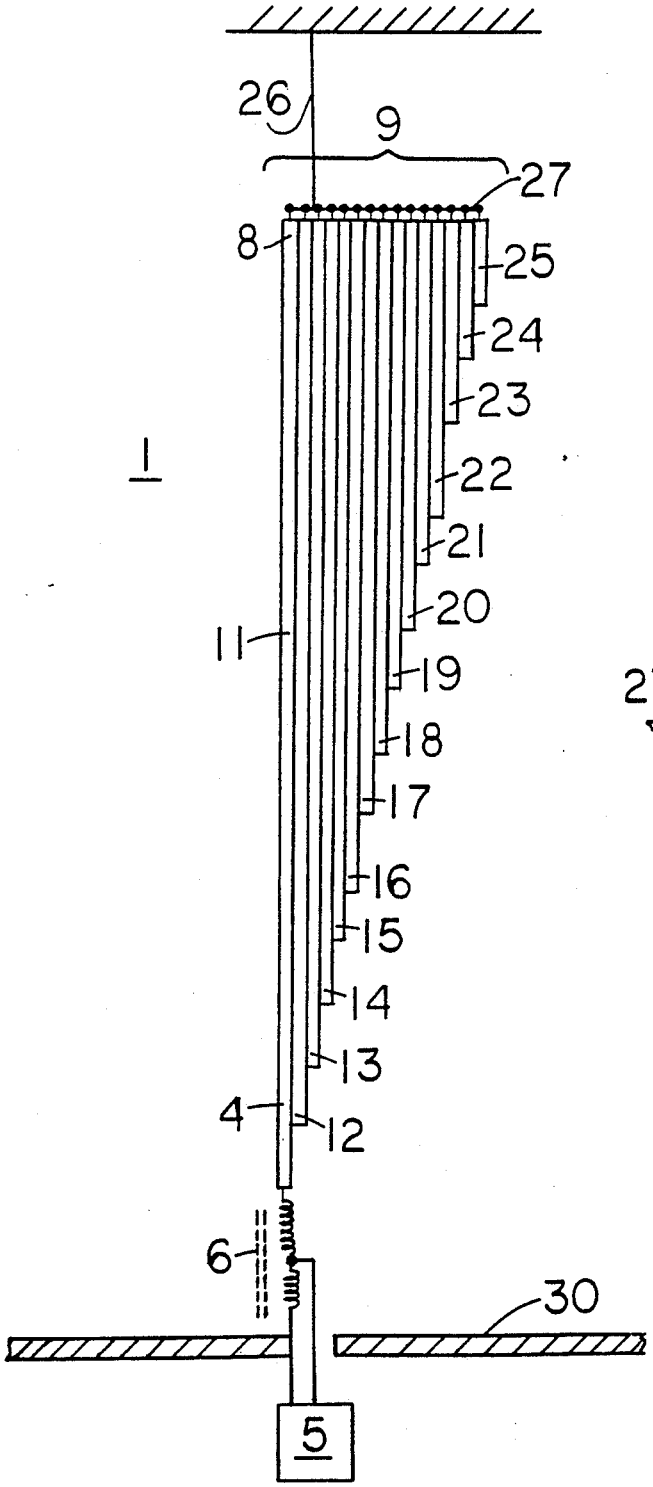
FIGS. 1 and 1(*a*) show an omnidirectional frequency independent broadband monopole antenna according to an aspect of the invention.
Figure 1A:
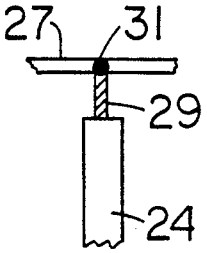

Referring now to the drawings, like reference numerals represent identical or corresponding parts throughout the several views.

FIG. 1 shows an omnidirectional frequency independent broadband antenna 1. While the antenna 1 can obviously be used to transmit or receive rf power the description and test results will concentrate on its transmitting characteristics. The antenna 1 is shown with a quarter wavelength long insulated conductor 11 driven at an end 4 by an rf source 5 through an impedance matching transformer 6. The loaded or "top" end 8 of conductor 11 is connected to a load 9. The load 9 consists of a plurality of insulated conductors 12–25 electrically connected in parallel to the loaded end 8 of conductor 11 using a bus wire 27. An enlarged section of antenna 1 is shown in FIG. 1(*a*) which shows a more detailed view of bus wire 27 soldered at joint 31 to stranded wire 29 of insulated conductor 24. The conductors 12–25 and conductor 11 are configured in a substantially planer, equidistantly and evenly spaced, and parallel relation to each other. The conductors 12–25 are dimesioned with progressively decreasing lengths in a tuned fashion to distinct resonant frequencies. While the antenna 1 may be constructed by using a plurality of stranded conductors commonly found in flat ribbon cable, such as 24 AWG stranded conductors in 3M flat cable (part no. 3451/24), the invention is by no means limited to this type of cable. However, this type of cable provides for a very uniform space between the parallel conductors of about ⅛ inch and provides flexibility for being rolled up or folded away in storage before use. The invention is also not limited to the size of conductor chosen. For example, a smaller size conductor of 32 AWG could be used. The antenna 1 can best be described as a "top" loaded quarter-wave vertical or monopole antenna with transmission line coupling between the resonant conductors.

For designing an antenna for a particular range of frequencies the standard wavelength-frequency conversion equation is:

$$\text{Wavelength in feet} = \frac{984}{\text{Frequency in magacycles}}$$

However, since quarter wavelength long antenna elements are used in this invention with the unit of measurement in inches the equation becomes.

$$\text{Quarter Wavelength in inches} = \frac{(0.25 \times 984 \times 12 \times .95)}{\text{Frequency in megacycles}}$$

The constant of 0.95 takes into consideration end effects of the antenna. The first step is to select the lowest frequency of the frequency band to be covered. The length for the quarter wavelength resonance of this element is then calculated. This will be the longest element. Next determine the frequency band that the fundamental frequency of the elements will need to cover. Usually just overlapping the third harmonic frequency of the longest element will be of sufficient bandwidth. Select the number of elements. Fewer elements provide for less uniform VSWR and reflectivity of the antenna characteristics over the operating frequency band; while more elements result in a bulkier antenna. Determine the ratio. The ratio is the length of an element to the length of the adjacent longer element. Note that as the ratio approaches 1 the number of elements required to span a frequency band becomes very large. The ratio must be related to the number of elements determined above to permit uniform coverage of the specific frequency band by the fundamental resonances of the tuned elements. The ratio is then multiplied to the above calculated one quarter wavelength longest element to get the length of the next longest element. The process of multiplying the ratio to each next longest (i.e., decreasing length) element is repeated in such a way that $L_{n+l}=L_{n\times}$ ratio, where $L_n$ represent the length of the elements.

For testing purposes a frequency range of 10 to 110 megahertz was chosen. In order for the antenna 1 to operate in this range of frequencies fifteen adjacent conductors using flat ribbon cable were chosen. In this case the ratio is 0.9216. The length of the conductor 11 and load conductors 12–25 are all different from each other and vary from 138 inches for the "driven" conductor 11 to the shortest of 44 inches for conductor 25. This represents approximately 20.321 MHz for conductor 11 and 63.731 MHz for conductor 25. The rest of the band is covered by the third harmonic or approximately 60 MHz for conductor 11 through 120 MHz for conductor 25. The conductors progressively decrease in length the further away each conductor is supported from said conductor 11. The conductors were cut at the appropriate length and the unused portion removed. The actual lengths of all the conductors 12–25 and conductor 11 are provided below.

| Conductor | Length (inches) |
|---|---|
| 11 | 138.0 |
| 12 | 127.0 |
| 13 | 116.0 |
| 14 | 105.0 |
| 15 | 98.0 |
| 16 | 91.5 |
| 17 | 85.5 |
| 18 | 78.5 |
| 19 | 72.5 |
| 20 | 67.5 |
| 21 | 61.5 |
| 22 | 57.5 |
| 23 | 53.0 |
| 24 | 49.0 |
| 25 | 44.0 |

While the length of the conductors are selected to represent approximately one quarter wavelength of the lowest frequencies of the frequency range to be covered, it must be noted that the actual tuned frequency of each conductor is influenced by that of the adjacent conductors. This effect is most obvious at the fundamental frequencies. The antenna 1 is shown vertically supported by an insulated support string 26 above a metallic surface 30 (the "ground" plane) and connected to the ground plane 30 and network analyzer 5 (which replaces the rf source) through the impedance matching transformer 6.

The relatively constant input impedance of this antenna design, over the required band of operating frequencies, permits the elimination of a matching network. Matching networks are usually needed to match the impedance characteristics of a transmitter to the antenna. The use of a matching network would cause considerable loss in operating efficiency of the antenna system, which is not the case with this antenna design. This antenna requires the use of a broad band transformer to match the impedance characteristics of the transmitter. There is very little loss of efficiency associated with the use of a transformer.

All measurements were made with a network analyzer that had a 50 ohm matched input impedance. Since the antenna had an approximately 200 ohm characteristic impedance, it was connected to the network analyzer by a broad band, 4 to 1 impedance ratio, toroidal transmission line matching transformer 6.

Figure 2:
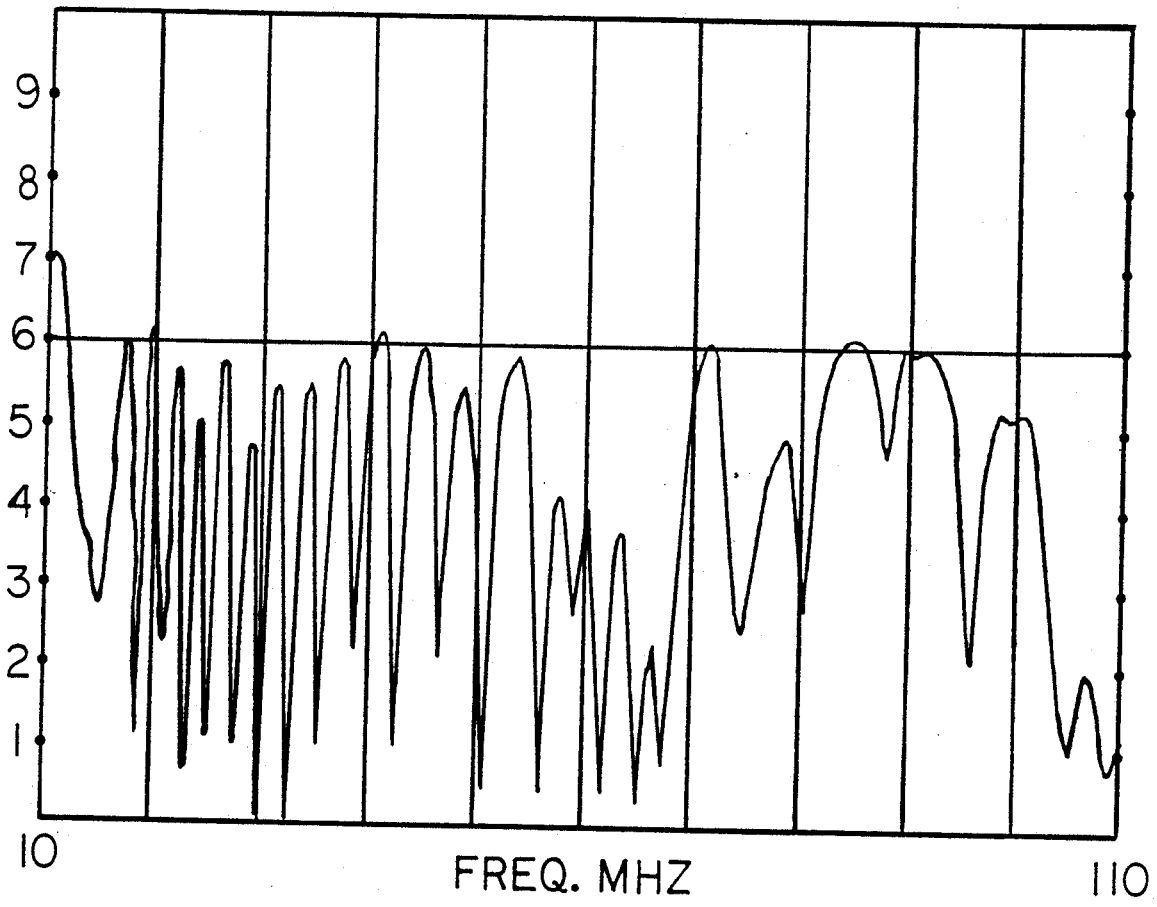
FIG. 2 shows a plot of reflection coefficient versus frequency over the band from 10 to 110 megahertz for the antenna of FIG. 1.

FIG. 2 shows a plot of the reflection coefficient of the antenna 1 with transformer 6 versus the test frequency from 10 to 110 megahertz. As can be seen in FIG. 2 the input impedance match of the antenna 1 and transformer 6 to the 50 ohm network analyzer did not exceed a reflection coefficient of approximately 0.6 (VSWR of 4:1) over the frequency range of approximately 12 megahertz through over 110 megahertz.

Figure 3:
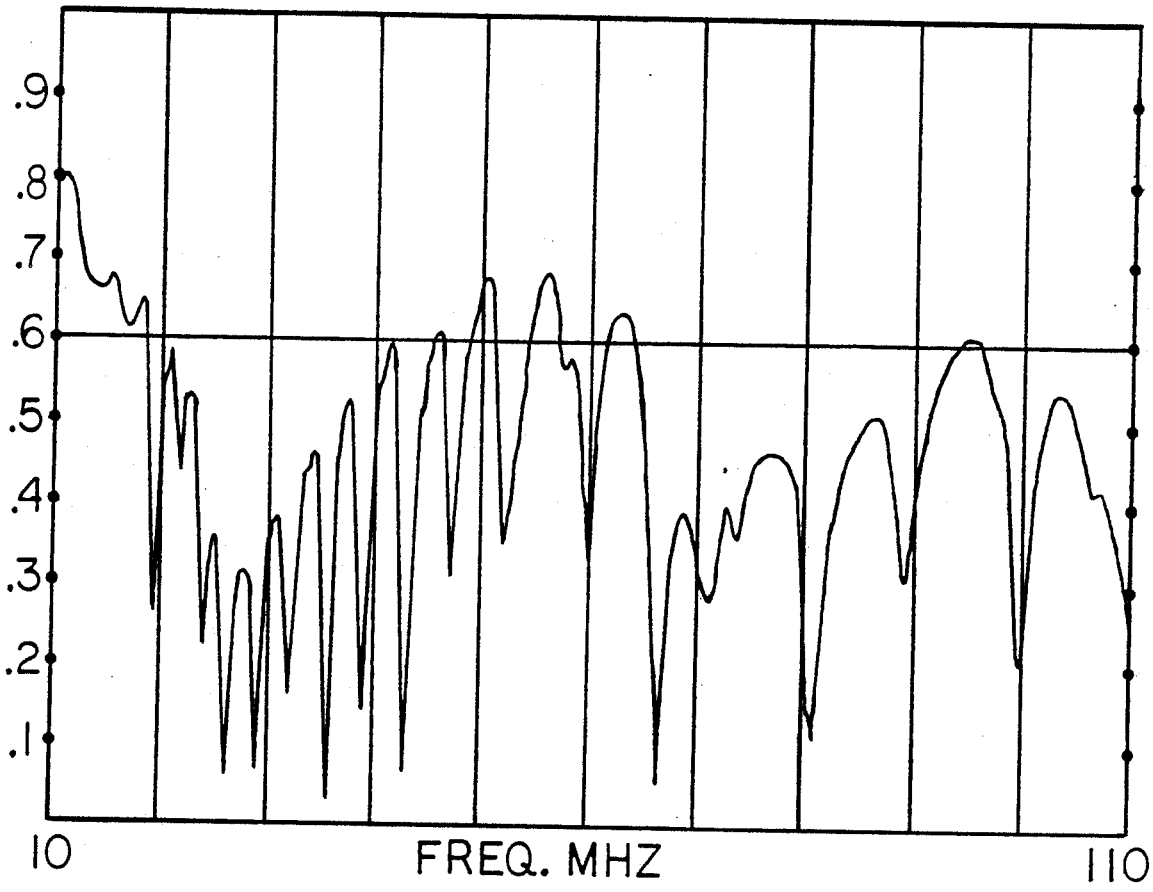
FIG. 3 shows a plot of reflection coefficient versus frequency over the band from 10 to 110 megahertz for an antenna of parallel driven monopoles.

In contrast to the results obtained as shown in FIG. 2, FIG. 3 shows a graphic demonstration of the fundamental difference between the above described monopole antenna 1 with unique "top" loading and an antenna constructed of parallel connected monopoles. The results shown in FIG. 3 are of an antenna configured as antenna 1 but connected so that all the conductors are driven as parallel monopoles. As can be seen in FIG. 3 a reflection coefficient of 0.7 (VSWR of 5.7:1) occurs at numerous frequencies within the 10 to 110 megahertz frequency band. While this configuration offers adequate coverage of the frequency band the configuration shown in FIG. 3 is clearly superior.

Figure 4:
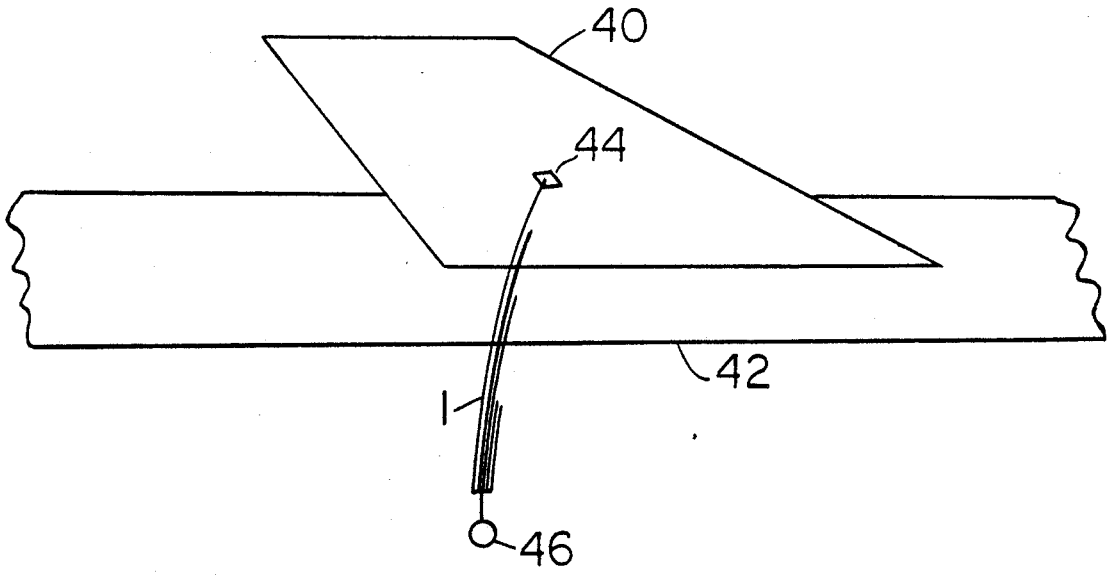
FIG. 4 shows a flexible omnidirectional frequency independent broadband monopole antenna used on an airplane.

FIG. 4 shows the antenna 1 used as a trailing wire antenna operating against the metallic wing 40 of an airplane 42. When the trap door 44 is opened the antenna 1 is unfolded and deployed using an end weight 46. The end weight forces the antenna into an approximate vertical configuration to achieve the desired vertical polarization of the antenna characteristics.

Obviously, numerous modifications and variations of the present invention are possible in light of the above teachings. For example, with appropriate scaling, the principle should be applicable to use throughout the electromagnetic communications spectrum. It is therefore to be understood that within the scope of the appended claims, the invention may be practiced otherwise than as specifically described herein.

What is claimed is:

1. A broadband omnidirectional multi-conductor antenna for radiating and receiving electromagnetic energy comprising:

a monopole element having a feed end and a loaded end electrically connected to a load wherein said load comprises a plurality of insulated conductors formed from flexible multistranded wires that extend from the loaded end towards the feed end in a substantially parallel and planer relation to each other and equidistantly spaced from one another.

2. The broadband omnidirectional multi-conductor antenna of claim 1 wherein said monopole element and said plurality of insulated conductors vary in length from about 138 inches to 44 inches.

3. The broadband omnidirectional multi-conductor antenna of claim 1 further comprising:

a weight attached to said loaded end of said monopole element whereby said weight pulls said antenna down in a vertical position from a folded position.

4. A broadband omnidirectional multi-conductor antenna for radiating and receiving electromagnetic energy from a lowest to a highest operating frequency comprising:

a monopole element having a loaded end and a feed end and a length equal to a quarter wavelength long of the lowest operating frequency; and a plurality of insulated conductors electrically connected to the loaded end of said monopole element, said conductors extending from the load end towards the feed end in a substantially planer and parallel relation to each other and said monopole element and dimensioned such that said conductors progressively decrease in length the further away each conductor is supported from said monopole element.

5. The broadband antenna of claim 4 wherein said plurality of insulated conductors are equidistantly spaced so that transmission line coupling occurs between adjacent conductors.

* * * * *